US006761206B2

(12) United States Patent
Newman

(10) Patent No.: US 6,761,206 B2
(45) Date of Patent: Jul. 13, 2004

(54) TRAVERSE CURTAIN ROD WITH FRONTAL OPERATION

(76) Inventor: Carl Samuel Newman, 9081 Lime Bay Blvd. #201, Tamarac, FL (US) 33321

( * ) Notice: Subject to any disclaimer, the term of this patent is extended or adjusted under 35 U.S.C. 154(b) by 0 days.

(21) Appl. No.: 10/271,105

(22) Filed: Oct. 15, 2002

(65) Prior Publication Data

US 2004/0069423 A1 Apr. 15, 2004

(51) Int. Cl.[7] ..... A47H 5/032
(52) U.S. Cl. ..... 160/345
(58) Field of Search ..... 160/123, 124, 160/126, 179, 180, 330, 340, 344, 345, 341, 346, 347; 21/105.1; 248/262; 16/94 D, 96 D

(56) References Cited

U.S. PATENT DOCUMENTS 559,716 A * 5/1896 Kerr ..... 160/343
1,819,379 A * 8/1931 Nudelman et al. ..... 160/344
2,713,898 A * 7/1955 Hartmann ..... 160/123
3,341,885 A * 9/1967 Johnson ..... 248/361
3,713,473 A * 1/1973 Ford ..... 160/345
4,274,467 A * 6/1981 Comeau ..... 160/199

* cited by examiner

*Primary Examiner*—Blair M. Johnson

(57) ABSTRACT

Attachments are provided to a traverse curtain rod, whereby the control cords are caused to hang down in front of the rod, and the draw curtain supported therefrom and away from the end of the rod, to avoid being hidden behind a proscenium surface created by a valence and drapery, or by a wall opening.

The improved traverse curtain rod usually has two attachments secured to the traverse curtain rod, each requiring a short slot in the rod located cooperatively with the a pulley which partially enters the rod, thus directing a control cord frontward and upward to pass around a second pulley and to hang down to permit opening and closing the draw curtain.

Depending upon the manner of mounting and locating the attachments to the rod, the internal cords are rerouted so as to appear as a pair near the left end of the rod, or at its right end, or as one cord on the left with the second on the right.

2 Claims, 2 Drawing Sheets

TRAVERSE CURTAIN ROD WITH FRONTAL OPERATION

BACKGROUND OF THE INVENTION

In certain curtain installations having traverse rods with internal control cords there may be a proscenium-like front surface created by a valence and drapery, or by a wall opening, in front of the curtain, thus making the external draw cord, segments for opening/closing the curtain difficult to find. Having decided that having the ends of the draw cord in front of the curtain, and visible at all times would be advantageous, I went about designing and building prototypes of a traverse curtain rod attachment to be fastened to a standard commercially available curtain rod in the space between the rod and the back face of the proscenium-like surface, providing means for accessing the internal draw cords, through slots cut into the surface of the rod, thus becoming external draw cords which would be visible from the front. Two of these have been in service in a public place for about 2 years. This invention reveals an improved embodiment which prevents the cords from falling off the attachment pulleys, and eliminates the need for precision fitting of the attachment.

SUMMARY OF THE INVENTION

This invention is for an improved embodiment of a pair of attachments, which can be fastened to a standard, commercially available traverse curtain rod having internal control cords; each attachment comprising structural members; a pair of pulleys mounted therewith and requiring one short slot to be cut into the wall of the rod. The rod may be of the type which has a single tubular section for containing the control cords and a full length slot for supporting the idler and master slides; or of the type which has a double tubular section, wherein one tubular section contains the control cords, and has a full length slot for the master slide and has a second tubular section with a full length slot for supporting the idler and master slides.

When the attachment is fastened to the traverse rod, a segment of a first pulley passes through the short slot cut in the tubular envelope of the rod section containing the control cords, and is positioned to engage a certain internal control cord, which passes over the first pulley, changing the orientation of the certain internal control cord from axial within the rod to being frontward in a plane essentially perpendicular to axis of the rod. As the internal control cord passes through the wall of the rod, its designation changes from "internal" to "external" control cord. At an appropriate location a second pulley is mounted to rotate on an axis parallel to the rod axis, the external control cord passes over the second pulley mounted on structural members so that its external control cord is hanging plumb, by virtue of having a weighted device at its end. The weighted knob, could be plain, decorative, or indicative of "OPEN" OR "CLOSE."

The new technology in this invention permits one external draw cord to be toward the first end of the rod, and the other to be toward the second end of the rod, both of which would be within the proscenium-like space. The loops of internal control cord which normally pass over the end pulleys of the curtain rod, are rerigged to the first pulleys of the attachments and/or the master sliders, as described elsewhere in this application. Additionally, the structural members would be configured to provide more permanent assembly means, improved means to prevent the control cords from falling off the pulleys and making the location of the first pulleys with respect to the edges of the slots less critical.

BRIEF DESCRIPTION OF THE DRAWINGS

An illustrative embodiment of the invention is shown in the accompanying drawings, in which:

Referring to FIG. 1, item 1 is a typical commercially available telescoping traverse rod comprising a tubular rod with full length slot, master slides 20 and 21, end mounting brackets 17 and 18, an indeterminate number of intermediate brackets 19, end pulleys 2 and 3, and other components normally installed therein, supporting curtain panels 4 and 5 having a plurality of idler attachment means 6; all installed on a wall 7 of indefinite extent, along with a front surface 8, also of indefinite extent, having a proscenium-like opening 9 defined by the boundary line 10 which may have any contour. Front surface 8 may be flexible or rigid. The attachments 11 and 12, being mirror images of each other, are removably installed at specific locations near, but spaced away from the end brackets, and between 1 and the rear surface of 8, the control cord ends 13 and 14 are visible in front of the curtains 4 and 5 with weights 15 and 16 affixed to 13 and 14 respectively.

Referring to FIG. 2, item 22 indicates the full length slot in the rod 1, in which the master slides 20 and 21 are free to move under the influence of draw cord segments 23, 24, and 26, which are fixed to master slides 20 and 21, as shown. Item 39 is each of the two lengthwise short slots cut through a surface of 1, (see FIG. 3) other than the surface containing 22. First end of control cord 14 is a continuation of control cord segment 23, which passes around end pulley 2, thence directly around a first pulley 29, and around a second pulley 30, both component parts of attachment 12. Second end of control cord 13 is a continuation of control cord segment 26, which passes around a first pulley 27, then around a second pulley 28, both part of attachment 11. Segment of control cord 24 passes around end pulley 3 connected to master slides 20 and 21 at its ends. Cord segments 37 and 40 are partly inside the rod 1, and partly outside. When first control cord end 14 is pulled down, as shown by the arrows, the various cord segments move endwise, and various pulleys turn, causing master slides 20 and 21 to move as indicated, thus parting the curtain panels 4 and 5.

Referring to FIG. 3, showing only rod 1, attachment 12 and the master slider 21 opposite 12 which comprises a Z shaped structural member 25, having a top surface 35 having clamping means for holding attachment 12 in position cooperatively with rod 1; such clamping means comprising bent over tab 31, for engaging a bead 32, and spring catch 33, engaging inclined surface 34, both part of rod 1. A second surface of 25 is a vertical portion 36, the bottom surface 43 is perpendicular to 36, but set at an angle with respect to the horizontal and located to cooperatively with first pulley 29 engage control cord segment 23 to pass around 29 frontward and upward, through short slot 39 becoming cord segment 37, thence to pass around second pulley 30, becoming cord segment 14. First short slot 39 is cut through a surface of rod 1, permitting partial entry of first pulley 29 to engage cord segment 23. As to attachment 11, which is a mirror image of attachment 12: draw cord segment 26 (FIG. 2) passes through a second slot 39 over pulley 27 becoming cord segment 40, thence over pulley 28 becoming cord segment 13.

Referring to FIG. 3, in each of the attachments 11 and 12, being mirror images of each other, a bracket 41 is affixed to surface 36 with an outstanding leg 42 parallel to and spaced away from surface 43, permitting pulley 29 to rotate freely on its shaft 44 which is spaced away from surface 36 by at least the root radius of the pulley plus the diameter of the control cord, thus providing means for preventing the control cord from jumping off the pulley 29 if the tension in the control cord is removed. (Refer to FIG. 4, items 36, 46, and 45 to visualize this arrangement.)

Referring to FIG. 4, affixed to the surface 35 is a bracket 45 having a leg 46 extending downward and parallel to and spaced away from surface 36, permitting pulley 30 to rotate freely on its shaft, which is spaced away from surface 45 by at least the root radius of the pulley plus the diameter of the control cord, thus providing means for preventing the control cord from jumping off the pulley 30. In this view, the relationship between the slot 39 and the attachment 12 can be seen.

Figure 1:
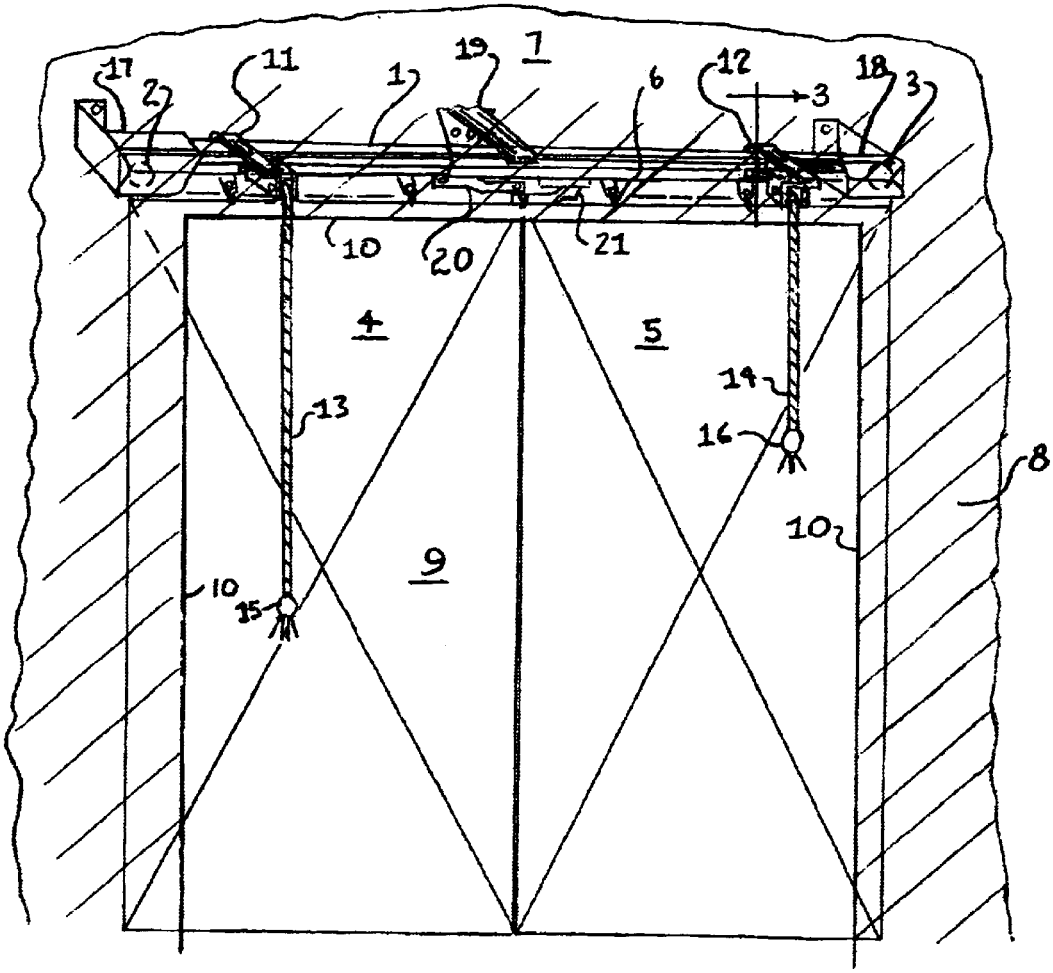
FIG. 1 is a general view, in perspective, showing the overall arrangement of components showing the installation of the attachment.
Figure 2:
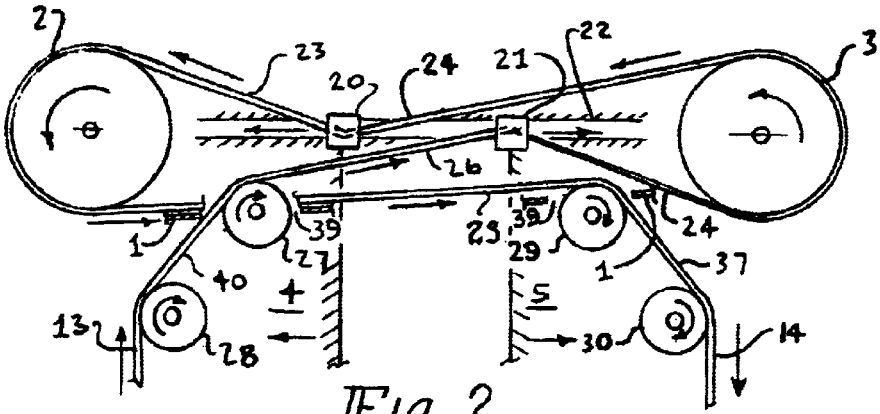
FIG. 2. is a schematic representation of the rigging of the control cord and its connection to the master carriers.
Figure 3:
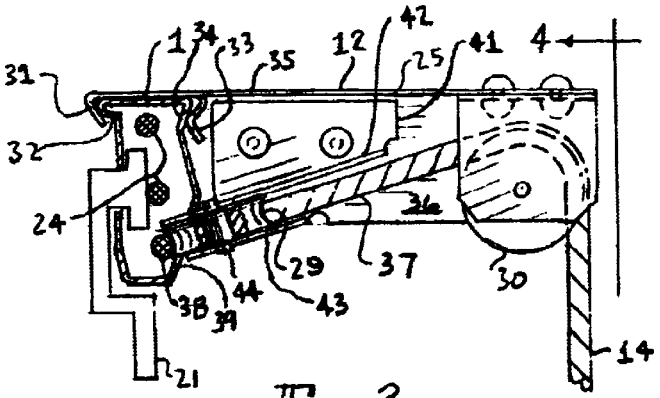
FIG. 3. is a side view of the attachment.
Figure 4:
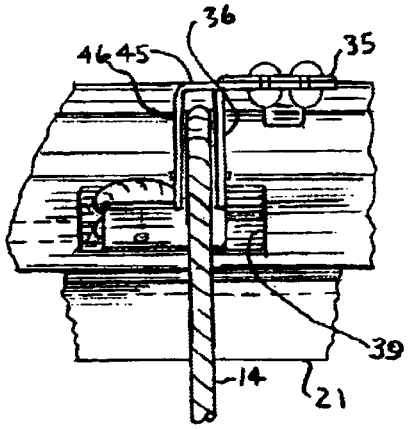
FIG. 4. is an end view of the attachment.

I claim:

1. A curtain operating system, comprising:

a hollow curtain rod;

at least one aperture in a front side surface of the curtain rod;

at least one elongate bracket having a first end connecting the bracket to the curtain rod so as to extend perpendicularly therefrom, each bracket further comprising:

a first pulley mounted on the bracket adjacent the first end and having at least a portion thereof extending through the aperture into the interior of the curtain rod, and a second pulley mounted on the bracket adjacent a second end of the bracket, the second end being spaced from the curtain rod, the axis of rotation of the first and second pulleys being perpendicular to each other;

an operating cord having a portion located inside the curtain rod and two opposing ends extending outside of the curtain rod;

the operating cord extending through the aperture and around the first and second pulleys to direct one of the opposing ends from inside the curtain rod to a location spaced in front of the curtain rod.

2. The curtain operating system of claim 1, further comprising:

the at least one aperture and the at least one bracket comprise, respectively, a second aperture and a second bracket, the second aperture corresponding to the second bracket;

the other opposing end of the operating cord extending through the second aperture and around the first and second pulleys of the second bracket to direct the second opposing end from inside the curtain rod to a location outside of and spaced in front of the curtain rod.

* * * * *

UNITED STATES PATENT AND TRADEMARK OFFICE

CERTIFICATE OF CORRECTION

PATENT NO. : 6,761,206 B2
DATED : July 13, 2004
INVENTOR(S) : Carl Samuel Newman It is certified that error appears in the above-identified patent and that said Letters Patent is hereby corrected as shown below:

Column 3,
Lines 24 and 26, should read as follows:

-- 4. A curtain operating system, comprising:

a hollow curtain rod having a plurality of elongate side surfaces and an elongate slot in one of the side surfaces and extending along the axis of the rod:

at least one aperture in one the side surfaces of the curtain rod other than the surface having the elongate slot;

at least one elongate bracket having a first end connecting the bracket to the curtain rod so as to extend perpendicularly therefrom, each bracket further comprising:

a first pulley mounted on the bracket adjacent the first end and having at least a portion thereof extending through the aperture into the interior of the curtain rod, and a second pulley mounted on the bracket adjacent a second end of the bracket, the second end being spaced from the curtain rod, the axis of rotation of the first and second pulleys being perpendicular to each other an operating cord having a portion located inside the curtain rod and two opposing ends extending outdise of the curtain rod;

the operating cord extending through the aperture and around the first and second pulleys to direct one of the opposing ends from inside the curtain rod to a location outside of the curtain rod. --

Column 4,
Line 16, should read as follows:

-- 5. The curtain operating system of claim 4, further comprising:

the at least one aperture and the at least one bracket comprise, respectively, a second aperture and a second bracket, the second aperture corresponding to the second bracket;

UNITED STATES PATENT AND TRADEMARK OFFICE

CERTIFICATE OF CORRECTION

PATENT NO. : 6,761,206 B2
DATED : July 13, 2004
INVENTOR(S) : Carl Samuel Newman It is certified that error appears in the above-identified patent and that said Letters Patent is hereby corrected as shown below:

Column 4 (cont'd), the other opposing end of the operating cord extending through the second aperture and around the first and second pulleys of the second bracket to direct the second opposing end from inside the curtain rod to a location outside of the curtain rod. --

Signed and Sealed this

Second Day of November, 2004

JON W. DUDAS
*Director of the United States Patent and Trademark Office*